US011732713B2

(12) United States Patent
Ignatiev et al.

(10) Patent No.: US 11,732,713 B2
(45) Date of Patent: Aug. 22, 2023

(54) CO-ROTATING SCROLL COMPRESSOR HAVING SYNCHRONIZATION MECHANISM

(71) Applicant: Emerson Climate Technologies, Inc., Sidney, OH (US)

(72) Inventors: Kirill M. Ignatiev, Sidney, OH (US); Mikhail A. Antimonov, Beavercreek, OH (US); Robert C. Stover, Versailles, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 17/519,721

(22) Filed: Nov. 5, 2021

(65) Prior Publication Data

US 2023/0145998 A1 May 11, 2023

(51) Int. Cl.
*F04C 18/02* (2006.01)
*F04C 29/00* (2006.01)

(52) U.S. Cl.
CPC ..... *F04C 18/023* (2013.01); *F04C 29/0057* (2013.01); *F04C 2240/30* (2013.01); *F04C 2240/50* (2013.01)

(58) Field of Classification Search
CPC ..... F04C 18/023–0238; F01C 1/023–0238
See application file for complete search history.

(56) References Cited

U.S. PATENT DOCUMENTS 2,415,011 A 1/1947 Hubacker
2,420,124 A 5/1947 Coulson
2,440,593 A 4/1948 Miller
3,817,664 A 6/1974 Bennett et al.
4,105,374 A 8/1978 Scharf
(Continued)

FOREIGN PATENT DOCUMENTS

CN 101080597 A 11/2007
CN 101682226 A 3/2010
(Continued)

OTHER PUBLICATIONS

Hasegawa, Hiroshi et al., "Dynamic Analysis of a Co-Rotating Scroll Compressor." International Compressor Engineering Conference, Paper 1313, pp. 643-648 (1998).
(Continued)

*Primary Examiner* — Laert Dounis
(74) *Attorney, Agent, or Firm* — Harness, Dickey & Pierce, P.L.C.

(57) ABSTRACT

A compressor includes a shell, a first compression member, a bearing housing and a second compression member. The first compression member is rotatable relative to the shell about a first axis. The bearing housing is coupled to the first compression member and rotatable relative to the shell about the first axis. The bearing housing includes a first pin that extends therefrom. The second compression member is rotatable relative to the shell about a second axis. The second compression member includes a base plate and an arcuate-shaped first pin pocket. The first pin pocket is formed in the base plate and receives the first pin. The first compression member is moveable between a first position in which the first pin is engaged with a surface of the first pin pocket and a second position in which the first pin is disengaged from the surface of the first pin pocket.

19 Claims, 5 Drawing Sheets

(56) References Cited

U.S. PATENT DOCUMENTS

| | | | | |
|---|---|---|---|---|
| 4,753,582 | A | 6/1988 | Morishita et al. | |
| 4,781,550 | A | 11/1988 | Morishita et al. | |
| 4,846,639 | A | 7/1989 | Morishita et al. | |
| 4,927,339 | A | 5/1990 | Riffe et al. | |
| 4,927,340 | A * | 5/1990 | McCullough | F01C 20/22 418/57 |
| 4,950,135 | A | 8/1990 | Tojo et al. | |
| 5,002,470 | A | 3/1991 | Gormley et al. | |
| 5,037,280 | A | 8/1991 | Nishida et al. | |
| 5,051,075 | A | 9/1991 | Young | |
| 5,069,605 | A | 12/1991 | Saitoh et al. | |
| 5,073,093 | A | 12/1991 | Takagi et al. | |
| 5,082,432 | A | 1/1992 | Kikuchi | |
| 5,090,876 | A | 2/1992 | Hashizume et al. | |
| 5,099,658 | A | 3/1992 | Utter et al. | |
| 5,123,818 | A | 6/1992 | Gormley et al. | |
| 5,129,798 | A | 7/1992 | Crum et al. | |
| 5,141,421 | A | 8/1992 | Bush et al. | |
| 5,142,885 | A | 9/1992 | Utter et al. | |
| 5,149,255 | A | 9/1992 | Young | |
| 5,178,526 | A | 1/1993 | Galante et al. | |
| 5,199,280 | A | 4/1993 | Riffe et al. | |
| 5,211,031 | A | 5/1993 | Murayama et al. | |
| 5,242,284 | A | 9/1993 | Mitsunaga et al. | |
| 5,256,042 | A | 10/1993 | McCullough et al. | |
| 5,256,044 | A | 10/1993 | Nieter et al. | |
| 5,263,822 | A | 11/1993 | Fujio | |
| 5,277,563 | A | 1/1994 | Wen-Jen et al. | |
| 5,314,316 | A | 5/1994 | Shibamoto et al. | |
| 5,328,341 | A * | 7/1994 | Forni | F04C 18/023 418/55.3 |
| 5,421,709 | A | 6/1995 | Hill et al. | |
| 5,449,279 | A | 9/1995 | Hill et al. | |
| 5,490,769 | A | 2/1996 | Calhoun | |
| 5,713,731 | A | 2/1998 | Utter et al. | |
| 5,791,883 | A | 8/1998 | Ban et al. | |
| 6,359,357 | B1 | 3/2002 | Blumenstock | |
| 6,616,430 | B2 | 9/2003 | Mori et al. | |
| 6,692,205 | B2 | 2/2004 | Moroi et al. | |
| 6,712,589 | B2 | 3/2004 | Mori et al. | |
| 6,776,593 | B1 | 8/2004 | Cho | |
| 6,993,910 | B2 | 2/2006 | Iwanami et al. | |
| 7,201,567 | B2 | 4/2007 | Wiertz et al. | |
| 7,344,367 | B2 | 3/2008 | Manole | |
| 8,007,260 | B2 | 8/2011 | Yanagisawa | |
| 8,058,762 | B2 | 11/2011 | Asano | |
| 8,179,016 | B2 | 5/2012 | Asano | |
| 8,323,006 | B2 | 12/2012 | Schofield et al. | |
| 8,373,326 | B2 | 2/2013 | Enomoto et al. | |
| 8,894,388 | B2 | 11/2014 | Lee et al. | |
| 9,169,841 | B2 | 10/2015 | Bonnefoi et al. | |
| 9,534,599 | B2 | 1/2017 | Rosson et al. | |
| 9,719,510 | B2 * | 8/2017 | Fujioka | F01C 21/003 |
| 10,215,174 | B2 | 2/2019 | Stover et al. | |
| 10,280,922 | B2 | 5/2019 | Doepker et al. | |
| 10,400,770 | B2 | 9/2019 | Fullenkamp et al. | |
| 10,415,567 | B2 | 9/2019 | Doepker et al. | |
| 10,465,954 | B2 | 11/2019 | Doepker et al. | |
| 10,718,330 | B2 | 7/2020 | Stover et al. | |
| 10,995,754 | B2 | 5/2021 | Doepker et al. | |
| 11,041,494 | B2 | 6/2021 | Hirata et al. | |
| 2001/0012489 | A1 | 8/2001 | Harakawa et al. | |
| 2002/0182094 | A1 | 12/2002 | Mori et al. | |
| 2005/0031465 | A1 | 2/2005 | Dreiman et al. | |
| 2005/0201884 | A1 | 9/2005 | Dreiman | |
| 2007/0077159 | A1 | 4/2007 | Tsuchiya et al. | |
| 2008/0087033 | A1 | 4/2008 | Bae et al. | |
| 2009/0104060 | A1 | 4/2009 | Sato et al. | |
| 2010/0164313 | A1 | 7/2010 | Langford et al. | |
| 2010/0225195 | A1 | 9/2010 | Asano et al. | |
| 2011/0002797 | A1 | 1/2011 | Takeuchi et al. | |
| 2011/0038737 | A1 | 2/2011 | Conry et al. | |
| 2012/0131945 | A1 | 5/2012 | Huang et al. | |
| 2012/0171060 | A1 | 7/2012 | Shin et al. | |
| 2012/0288393 | A1 | 11/2012 | Sato | |
| 2013/0036762 | A1 | 2/2013 | Shaffer et al. | |
| 2013/0181565 | A1 | 7/2013 | Petro et al. | |
| 2014/0361651 | A1 | 12/2014 | Park et al. | |
| 2016/0043602 | A1 | 2/2016 | Hosek et al. | |
| 2016/0123147 | A1 * | 5/2016 | Fujioka | F01C 1/0238 418/55.1 |
| 2017/0051741 | A1 | 2/2017 | Shaffer et al. | |
| 2018/0013336 | A1 | 1/2018 | Li | |
| 2018/0080446 | A1 | 3/2018 | Choi et al. | |
| 2018/0087509 | A1 | 3/2018 | Johnson et al. | |
| 2018/0223842 | A1 | 8/2018 | Stover et al. | |
| 2018/0223843 | A1 | 8/2018 | Doepker et al. | |
| 2018/0223848 | A1 | 8/2018 | Doepker et al. | |
| 2018/0223849 | A1 | 8/2018 | Doepker et al. | |
| 2018/0224171 | A1 | 8/2018 | Doepker et al. | |
| 2018/0363654 | A1 | 12/2018 | Doepker et al. | |
| 2019/0162184 | A1 * | 5/2019 | Yamashita | F04C 29/00 |
| 2019/0178247 | A1 | 6/2019 | Yamashita et al. | |
| 2019/0186488 | A1 | 6/2019 | Stover et al. | |
| 2019/0376513 | A1 | 12/2019 | Hirata et al. | |
| 2020/0018310 | A1 * | 1/2020 | Hirata | F04C 18/023 |
| 2020/0025199 | A1 | 1/2020 | Wilson et al. | |
| 2020/0158109 | A1 | 5/2020 | Jo et al. | |

FOREIGN PATENT DOCUMENTS

| | | | | |
|---|---|---|---|---|
| CN | 102480197 | A | 5/2012 | |
| CN | 102777382 | A | 11/2012 | |
| CN | 103807166 | A | 5/2014 | |
| CN | 104520599 | A | 4/2015 | |
| CN | 105612351 | A | 5/2016 | |
| CN | 105971880 | A | 9/2016 | |
| CN | 208106754 | U | 11/2018 | |
| CN | 208106761 | U | 11/2018 | |
| CN | 208106763 | U | 11/2018 | |
| CN | 208138137 | U | 11/2018 | |
| DE | 102018107460 | A1 * | 10/2018 | F04C 18/0215 |
| EP | 0534891 | A1 | 3/1993 | |
| JP | 59110885 | A * | 6/1984 | |
| JP | S59110885 | A | 6/1984 | |
| JP | S62210279 | A | 9/1987 | |
| JP | H02140477 | A | 5/1990 | |
| JP | H02207190 | A | 8/1990 | |
| JP | H06101659 | A | 4/1994 | |
| JP | H06213232 | A | 8/1994 | |
| JP | H0712076 | A | 1/1995 | |
| JP | H07229481 | A | 8/1995 | |
| JP | H07332260 | A | 12/1995 | |
| JP | H08121358 | A | 5/1996 | |
| JP | H08144972 | A | 6/1996 | |
| JP | 2004052657 | A | 2/2004 | |
| JP | 2012115084 | A | 6/2012 | |
| JP | 2012215092 | A * | 11/2012 | |
| JP | 2015004296 | A | 1/2015 | |
| JP | 2015124653 | A | 7/2015 | |
| JP | 2018-100640 | A | 6/2018 | |
| JP | 2018132036 | A | 8/2018 | |
| KR | 910001253 | A | 1/1991 | |
| KR | 200167998 | Y1 | 2/2000 | |
| KR | 20110000545 | A | 1/2011 | |
| KR | 20120069713 | A | 6/2012 | |
| KR | 20150006278 | A | 1/2015 | |
| KR | 20160091106 | A | 8/2016 | |
| KR | 20180031389 | A | 3/2018 | |
| TW | 223674 | B | 5/1994 | |
| WO | WO-2018116696 | A1 | 6/2018 | |
| WO | WO-2018134739 | A1 | 7/2018 | |
| WO | WO-2020050826 | A1 | 3/2020 | |

OTHER PUBLICATIONS

McMullen, Patrick T. et al., "Combination Radial-Axial Magnetic Bearing." Seventh International Symposium on Magnetic Bearings, Zürich (Aug. 23-25, 2000).

Hinckley, Mark, "New Levels of Performance with Magnetic Bearings." Design World, https://www.designworldonline.com/new-levels-of-performance-with-magnetic-bearings/ (Oct. 8, 2010).

(56) References Cited

OTHER PUBLICATIONS

Mahmoudi, A et al., "Axial-flux permanent-magnet machine modeling, design, simulation and analysis." Scientific Research and Essays, vol. 6, No. 12, pp. 2525-2549 (Jun. 18, 2011).
Faculty of Engineering—Electric Energy Group, "Design of Electric Machines: Axial Flux Machines." Electric Energy Magazine, No. 4, Mondragon Unibertsitatea, pp. 1-21 (Jan.-Jun. 2013).
Frank, Evan et al., "Ring Motors—Design Flexibility for Innovative Configurations." Motion Control and Automation Technology, NASA Tech Briefs, pp. 14-15 (Sep. 2014).
Office Action regarding U.S. Appl. No. 15/205,907, dated May 29, 2018.
International Search Report regarding International Application No. PCT/US2018/017069, dated Jun. 12, 2018.
Written Opinion of the International Searching Authority regarding International Application No. PCT/US2018/017069, dated Jun. 12, 2018.
Search Report regarding European Patent Application No. 18155363.7, dated Jul. 2, 2018.
Search Report regarding European Patent Application No. 18155362.9, dated Jul. 2, 2018.
Office Action regarding U.S. Appl. No. 15/425,374, dated Jul. 27, 2018.
Restriction Requirement regarding U.S. Appl. No. 15/425,428, dated Aug. 8, 2018.
Search Report regarding European Patent Application No. 18155358.7, dated Oct. 11, 2018.
Office Action regarding U.S. Appl. No. 15/425,428, dated Nov. 1, 2018.
Notice of Allowance regarding U.S. Appl. No. 15/425,374, dated Nov. 7, 2018.
Notice of Allowance regarding U.S. Appl. No. 15/425,374, dated Nov. 30, 2018.
Office Action regarding U.S. Appl. No. 16/114,912, dated Dec. 3, 2018.
Restriction Requirement regarding U.S. Appl. No. 15/425,319, dated Jan. 10, 2019.
Notice of Allowance regarding U.S. Appl. No. 15/425,428, dated Feb. 15, 2019.
Office Action regarding Korean Patent Application No. 10-2018-0013623, dated Feb. 18, 2019. Translation provided by KS KORYO International IP Law Firm.
Office Action regarding Chinese Patent Application No. 201810116198.8, dated Feb. 26, 2019. Translation provided by Unitalen Attorneys at Law.
Office Action regarding Korean Patent Application No. 10-2018-0013620, dated Feb. 26, 2019. Translation provided by KS KORYO International IP Law Firm.
Office Action regarding Chinese Patent Application No. 201810119087.2, dated Feb. 27, 2019. Translation provided by Unitalen Attorneys at Law.
Office Action regarding Chinese Patent Application No. 201810118025.X, dated Mar. 4, 2019. Translation provided by Unitalen Attorneys at Law.
Office Action regarding Korean Patent Application No. 10-2018-0013622, dated Mar. 20, 2019. Translation provided by KS KORYO International IP Law Firm.
Office Action regarding Chinese Patent Application No. 201810119178.6, dated Mar. 21, 2019. Translation provided by Unitalen Attorneys at Law.
Office Action regarding Korean Patent Application No. 10-2018-0013621, dated Mar. 25, 2019. Translation provided by KS KORYO International IP Law Firm.
Office Action regarding U.S. Appl. No. 16/114,912, dated Mar. 28, 2019.
Office Action regarding U.S. Appl. No. 15/425,319, dated Apr. 1, 2019.
Office Action regarding Korean Patent Application No. 10-2018-0013620, dated May 28, 2019. Translation provided by KS KORYO International IP Law Firm.
Restriction Requirement regarding U.S. Appl. No. 15/425,266, dated May 28, 2019.
Notice of Allowance regarding U.S. Appl. No. 16/114,912, dated Jun. 10, 2019.
Office Action regarding Korean Patent Application No. 10-2018-0013622, dated Jun. 26, 2019. Translation provided by KS KORYO International IP Law Firm.
Office Action regarding U.S. Appl. No. 16/284,653, dated Jul. 29, 2019.
Notice of Allowance regarding U.S. Appl. No. 15/425,319, dated Aug. 7, 2019.
Office Action regarding U.S. Appl. No. 15/205,907, dated Aug. 9, 2019.
Office Action regarding Chinese Patent Application No. 201810116198.8, dated Aug. 26, 2019. Translation provided by Unitalen Attorneys at Law.
Office Action regarding Chinese Patent Application No. 201810118025.X, dated Aug. 28, 2019. Translation provided by Unitalen Attorneys at Law.
Office Action regarding Indian Patent Application No. 201824003471, dated Sep. 11, 2019.
Office Action regarding Mexican Patent Application No. MX/a/2017/008998, dated Oct. 1, 2019. Translation provided by Panamericana de Patentes y Marcas, S.C.
Office Action regarding U.S. Appl. No. 15/425,266, dated Oct. 8, 2019.
Office Action regarding Chinese Patent Application No. 201810119178.6, dated Oct. 18, 2019. Translation provided by Unitalen Attorneys at Law.
Office Action regarding Chinese Patent Application No. 201810118025.X, dated Feb. 25, 2020. Translation provided by Unitalen Attorneys at Law.
Notice of Allowance regarding U.S. Appl. No. 16/284,653, dated Mar. 12, 2020.
Office Action regarding U.S. Appl. No. 15/425,266, dated Apr. 3, 2020.
Office Action regarding U.S. Appl. No. 15/877,870, dated Apr. 13, 2020.
Office Action regarding Chinese Patent Application No. 201880016172.4, dated Jul. 1, 2020. Translation provided by Unitalen Attorneys at Law.
Office Action regarding Chinese Patent Application No. 201710551365.7, dated Jul. 3, 2020. Summary translation provided by Zhongzi Law Office.
Office Action regarding U.S. Appl. No. 15/425,266, dated Jul. 6, 2020.
Office Action regarding European Patent Application No. 18155358.7, dated Oct. 6, 2020.
Ex Parte Quayle Action regarding U.S. Appl. No. 15/877,870, dated Oct. 19, 2020.
Office Action regarding U.S. Appl. No. 15/425,266, dated Aug. 28, 2020.
Office Action regarding European Patent Application No. 18155363.7, dated Oct. 7, 2020.
Office Action regarding European Patent Application No. 18155362.9, dated Oct. 2, 2020.
Office Action regarding Korean Patent Application No. 10-2019-7023591, dated Oct. 19, 2020. Translation provided by Y.S. Chang & Associates.
Notice of Allowance regarding U.S. Appl. No. 15/877,870, dated Jan. 28, 2021.
Office Action regarding U.S. Appl. No. 15/425,266, dated Feb. 10, 2021.
Office Action regarding Chinese Patent Application No. 201880016172.4, dated Feb. 26, 2021. Translation provided by Unitalen Attorneys at Law.
International Search Report regarding International Application No. PCT/US2020/060527, dated Mar. 5, 2021.
Written Opinion of the International Searching Authority regarding International Application No. PCT/US2020/060527, dated Mar. 5, 2021.
Notice of Allowance regarding U.S. Appl. No. 15/425,266 dated May 19, 2021.

(56) References Cited

OTHER PUBLICATIONS

Supplemental Notice of Allowability regarding U.S. Appl. No. 15/425,266 dated May 27, 2021.
Search Report regarding European Patent Application No. 21186670.2, dated Oct. 26, 2021.
Non-Final Office Action regarding U.S. Appl. No. 17/097,478 dated Nov. 1, 2021.
Notice of Allowance regarding U.S. Appl. No. 17/097,478 dated Feb. 16, 2022.
Non-Final Office Action regarding U.S. Appl. No. 17/519,953 dated Jul. 20, 2022.
International Search Report and Written Opinion regarding Application No. PCT/US2022/048544, dated Mar. 15, 2023.
Notice of Allowance regarding U.S. Appl. No. 17/519,876 dated Dec. 8, 2022.
Office Action dated Feb. 1, 2023, in corresponding U.S. Appl. No. 17/519,953.
International Search Report and Written Opinion regarding Application No. PCT/US2022/046553 dated Feb. 17, 2023.

* cited by examiner

CO-ROTATING SCROLL COMPRESSOR HAVING SYNCHRONIZATION MECHANISM

FIELD

The present disclosure relates to a co-rotating scroll compressor having a synchronization mechanism.

BACKGROUND

This section provides background information related to the present disclosure and is not necessarily prior art.

A climate-control system (e.g., a heat-pump system, an air-conditioning system, a refrigeration system, etc.) may include a fluid circuit having an outdoor heat exchanger, an indoor heat exchanger, an expansion device disposed between the indoor and outdoor heat exchangers, and a compressor circulating a working fluid between the indoor and outdoor heat exchangers. Efficient and reliable operation of the compressor is desirable to ensure that the climate-control system in which the compressor is installed is capable of effectively and efficiently providing a cooling and/or heating effect on demand.

SUMMARY

This section provides a general summary of the disclosure, and is not a comprehensive disclosure of its full scope or all of its features.

In one form, the present disclosure discloses a compressor that includes a shell assembly, a first compression member, a bearing housing, and a second compression member. The first compression member is rotatable relative to the shell assembly about a first axis. The bearing housing is coupled to the first compression member and rotatable relative to the shell assembly about the first axis. The bearing housing includes a first pin extending therefrom. The second compression member is rotatable relative to the shell assembly about a second axis that is spaced apart from the first axis (i.e., the first and second axes are not collinear with each other). The second compression member cooperates with the first compression member to define fluid pockets. The second compression member including a base plate and a first pin pocket. The first pin pocket is formed in the base plate and receives the first pin. The first compression member is moveable between a first position in which the first pin is engaged with a surface of the first pin pocket and a second position in which the first pin is disengaged from the surface of the first pin pocket.

In some configurations of the compressor of the above paragraph, the first pin pocket is arcuate and the surface of the first pin pocket is a working surface having a first arc center. The first pin pocket further includes a non-working surface having a second arc center that is spaced apart from the first arc center.

In some configurations of the compressor of any one or more of the above paragraphs, the working surface spans angularly at least 60 degrees.

In some configurations of the compressor of any one or more of the above paragraphs, the working surface has a predetermined angle. The predetermined angle is defined by 360 degrees/number of pins.

In some configurations of the compressor of any one or more of the above paragraphs, the first pin is disengaged from the working surface and the non-working surface when the first compression member is in the second position.

In some configurations of the compressor of any one or more of the above paragraphs, the first pin pocket further includes a transition surface disposed between the working surface and the non-working surface. The first compression member is movable to a third position in which the first pin is engaged with the transition surface.

In some configurations of the compressor of any one or more of the above paragraphs, the bearing housing includes a second pin and the second compression member includes an arcuate-shaped second pin pocket formed in the base plate. The second pin extends through the second pin pocket and is disengaged with a surface of the second pin pocket when the first compression member is in the first position.

In some configurations of the compressor of any one or more of the above paragraphs, the second pin is adjacent to the first pin.

In some configurations of the compressor of any one or more of the above paragraphs, the bearing housing includes a second pin and the second compression member includes an arcuate-shaped second pin pocket formed in the base plate. The second pin extends through the second pin pocket.

In some configurations of the compressor of any one or more of the above paragraphs, the second pin pocket includes a second working surface, a second non-working surface and a transition surface disposed between the second working surface and second the non-working surface. The second pin is engaged with the transition surface when the first compression member is in the first position. The second working surface having a third arc center and spanning angularly at least 60 degrees.

In some configurations of the compressor of any one or more of the above paragraphs, the second pin is adjacent to the first pin.

In some configurations of the compressor of any one or more of the above paragraphs, a driveshaft is coupled to the first compression member and includes first and second housings that receive respective first and second pins thereby coupling the first compression member and the bearing housing.

In some configurations of the compressor of any one or more of the above paragraphs, the first pin is a cylindrically-shaped.

In some configurations of the compressor of any one or more of the above paragraphs, the first pin pocket is formed in an outer diametrical surface of the base plate and extends through the base plate.

In some configurations of the compressor of any one or more of the above paragraphs, the first pin extends from the bearing housing in an axial direction (e.g., in a direction parallel to the first and second axes).

In some configurations of the compressor of any one or more of the above paragraphs, a driveshaft is coupled to the first compression member and includes a first housing that receives the first pin thereby coupling the first compression member and the bearing housing.

In another form, the compressor of the present disclosure discloses a shell assembly, a first compression member, a bearing housing, and a second compression member. The first compression member is rotatable relative to the shell assembly about a first axis. The bearing housing is coupled to the first compression member and rotatable relative to the shell assembly about the first axis. The bearing housing includes a plurality of pins extending therefrom. The second compression member is rotatable relative to the shell assembly about a second axis that is spaced apart from the first axis (i.e., the first and second axes are not collinear with each other). The second compression member cooperates with the first compression member to define fluid pockets. The second compression member includes a base plate and pin pockets formed in the base plate and receiving a respective pin. Each of the pin pockets has a working surface. The first compression member is moveable between a first position in which only one of the pins of the plurality of pins is engaged with the working surface of a respective pin pocket and a second position in which the one of the pins of the plurality of pins is disengaged from the working surface of the respective pin pocket.

In some configurations of the compressor of the above paragraph, the working surface of each pin pocket has a first arc center and a non-working surface of each pin pocket has a second arc center. The second arc center is spaced apart from the first arc center.

In some configurations of the compressor of any one or more of the above paragraphs, each of the pin pockets has a transition surface disposed between the working surface and the non-working surface. Only one of the pins of the plurality of pins is moveably engaged with the transition surface of a respective pin pocket when the first compression member is in the first position.

In some configurations of the compressor of any one or more of the above paragraphs, the working surface spans angularly at least 60 degrees.

In some configurations of the compressor of any one or more of the above paragraphs, the working surface has a predetermined angle. The predetermined angle is defined by 360 degrees/number of pins.

In some configurations of the compressor of any one or more of the above paragraphs, the pin pockets are circumferentially disposed and spaced apart around the base plate and the pins are circumferentially disposed and spaced apart around an axial end surface of the bearing housing. The pin pockets are arcuate-shaped.

In some configurations of the compressor of any one or more of the above paragraphs, the pin pockets are formed in an outer diametrical surface of the base plate and extend through the base plate.

In yet another form, the compressor of the present disclosure discloses a shell assembly, a first compression member, a second compression member, and a pin. The first compression member is rotatable relative to the shell assembly about a first axis. The second compression member is rotatable relative to the shell assembly about a second axis that is spaced apart from the first axis. The second compression member cooperates with the first compression member to define fluid pockets. The second compression member includes a base plate and an arcuate-shaped pin pocket. The pin pocket is formed in the base plate. The pin is coupled to the first compression member and is received in the pin pocket. The first compression member is moveable between a first position in which the pin is engaged with a surface of the pin pocket and a second position in which the pin is disengaged from the surface of the pin pocket.

In some configurations of the compressor of the above paragraph, the surface of the pin pocket is a working surface having a first arc center. The pin pocket further includes a non-working surface having a second arc center that is spaced apart from the first arc center.

In some configurations of the compressor of any one or more of the above paragraphs, the working surface spans angularly at least 60 degrees.

In some configurations of the compressor of any one or more of the above paragraphs, the pin is disengaged from the working surface and the non-working surface when the first compression member is in the second position.

In some configurations of the compressor of any one or more of the above paragraphs, the pin pocket further includes a transition surface disposed between the working surface and the non-working surface. The first compression member is movable to a third position in which the pin is engaged with the transition surface.

In some configurations of the compressor of any one or more of the above paragraphs, a bearing housing is coupled to the first compression member via the pin and is rotatable relative to the shell assembly about the first axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
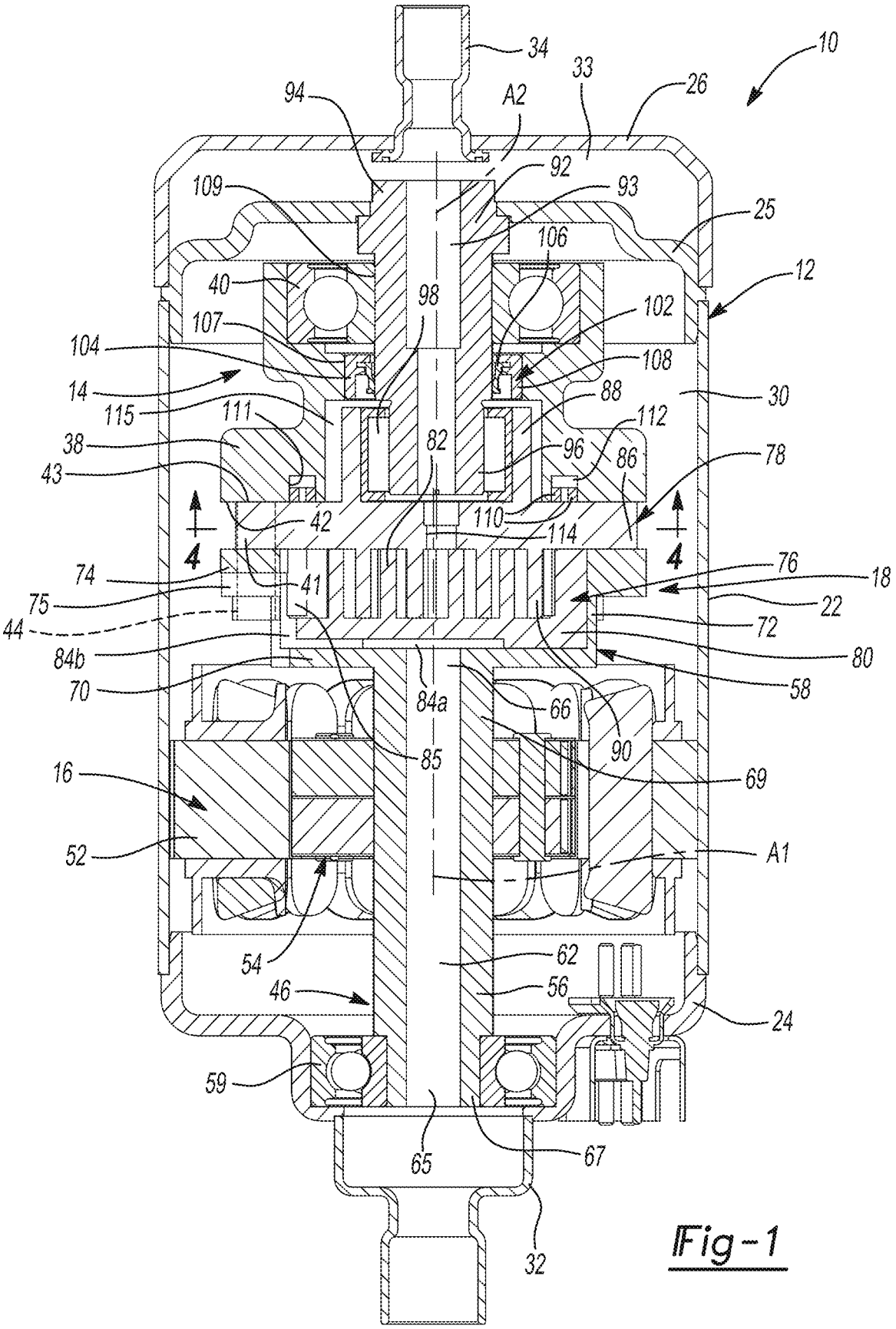
FIG. 1 is a cross-sectional view of a compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a bearing housing assembly 14, a motor assembly 16, and a compression mechanism 18.

The shell assembly 12 may generally form a compressor housing and may include a cylindrical shell 22, a first end cap 24 at one end of the shell 22, a partition 25 and a second end cap 26 at another end of the shell 22. The shell 22 and the first end cap 24 may cooperate to define a suction-pressure chamber 30. A suction gas inlet fitting 32 may be attached to the shell assembly 12 at an opening in the first end cap 24. Suction-pressure working fluid (i.e., low-pressure working fluid) may be drawn into the compression mechanism 18 via the suction gas inlet fitting 32 for compression therein.

Figure 2:
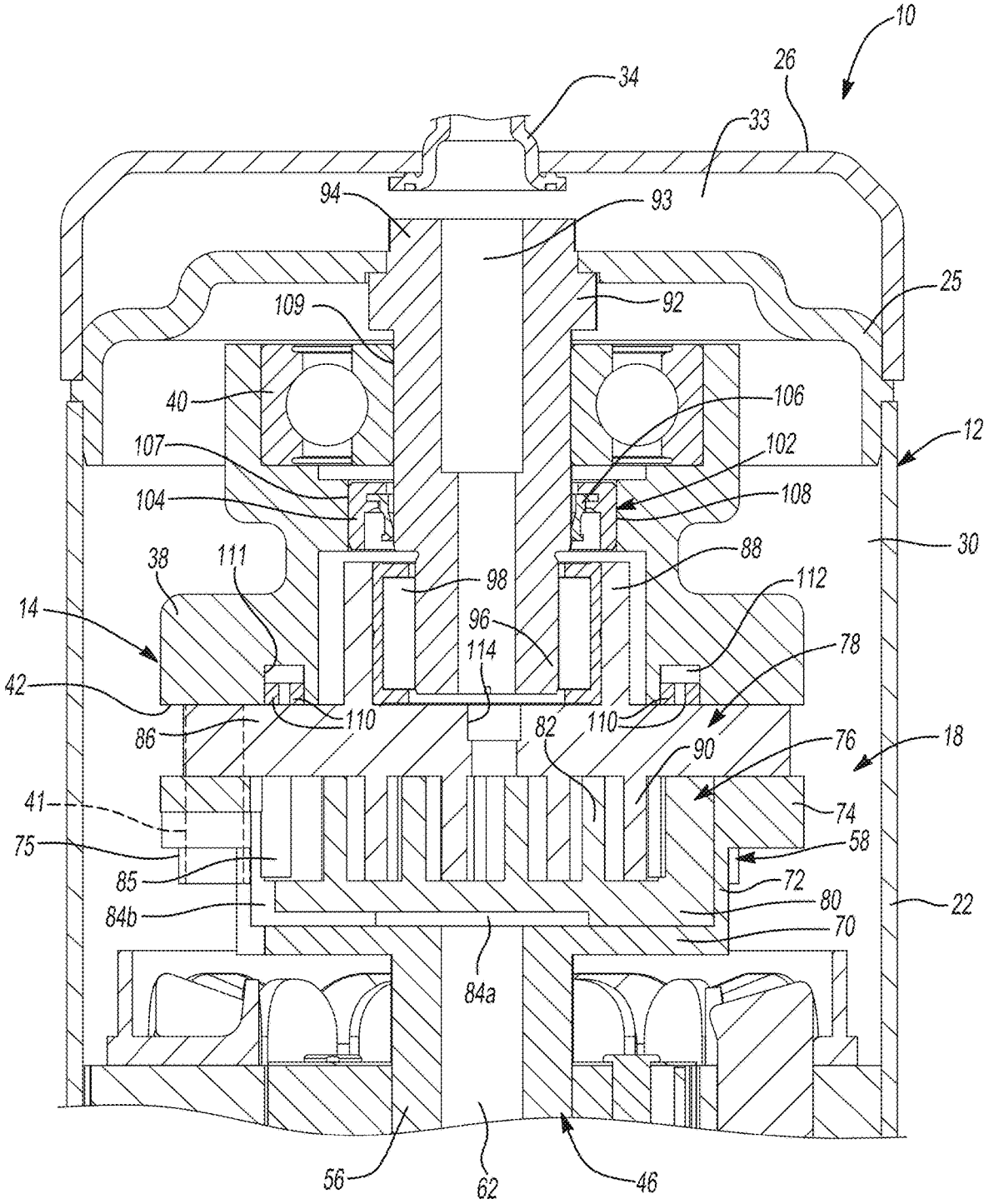
FIG. 2 is a partial cross-sectional view of the compressor of FIG. 1.

As shown in FIGS. 1 and 2, the partition 25 and the second end cap 26 may cooperate to define a discharge-pressure chamber 33. The partition 25 may separate the discharge-pressure chamber 33 from the suction-pressure chamber 30. A discharge gas outlet fitting 34 may be attached to the shell assembly 12 at another opening in the second end cap 26 and may communicate with the discharge-pressure chamber 33. Discharge-pressure working fluid (i.e., working fluid at a higher pressure than suction pressure) may be discharged by the compression mechanism 18 and may flow into the discharge-pressure chamber 33. The discharge-pressure working fluid in the discharge-pressure chamber 33 may exit the compressor 10 through the discharge-gas-outlet fitting 34. In some configurations, a discharge valve (e.g., a check valve) may be disposed within or adjacent the discharge-gas-outlet fitting 34 and may allow fluid to exit the discharge-pressure chamber 33 through the discharge-gas-outlet fitting 34 and prevent fluid from entering the discharge-pressure chamber 33 through the discharge-gas-outlet fitting 34.

Figure 4:
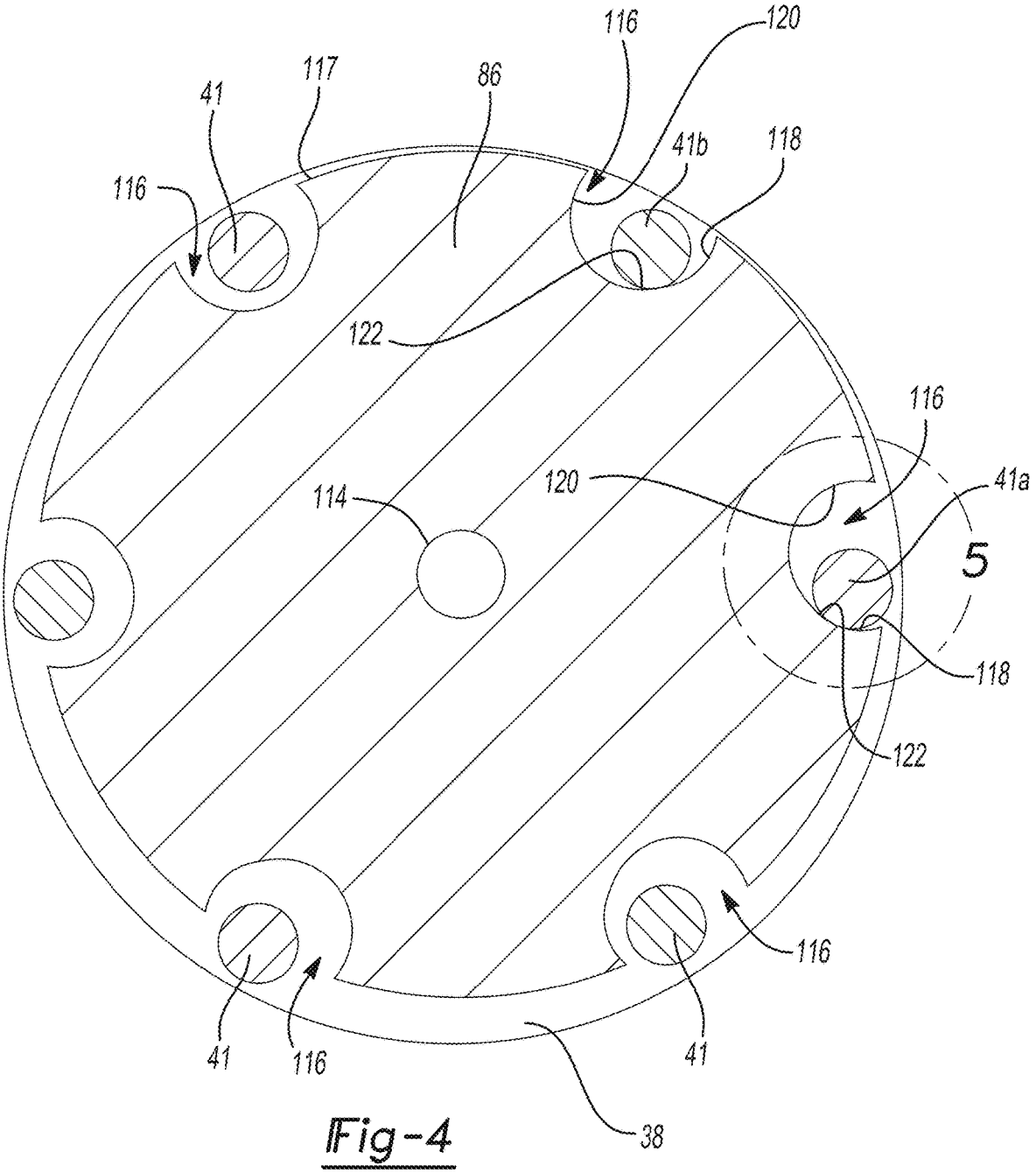
FIG. 4 is a cross-sectional view of the compressor taken along line 4-4 of FIG. 1.
Figure 5:
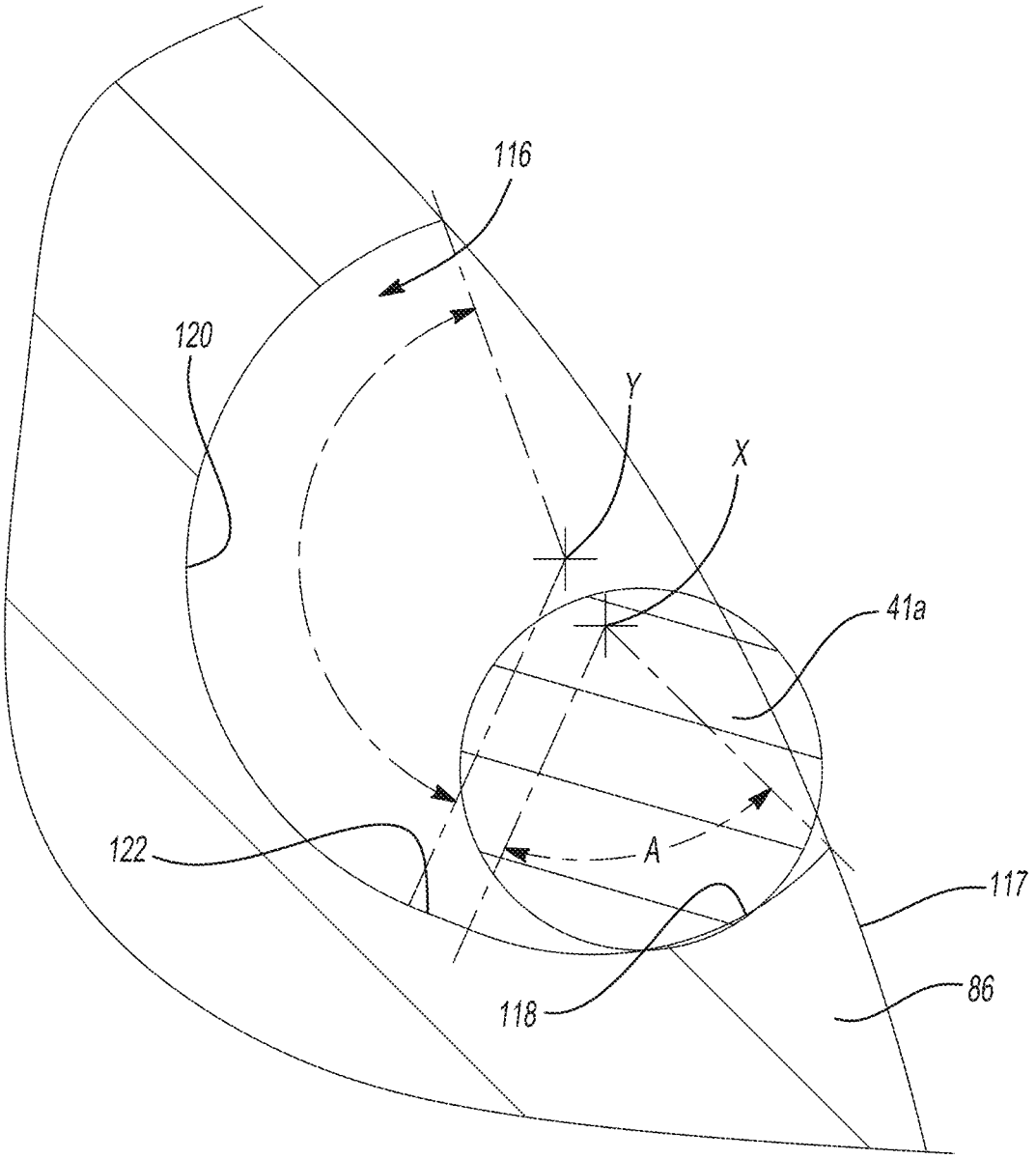
FIG. 5 is a close-up view of a portion of the compressor indicated as area 5 in FIG. 4.

The bearing housing assembly 14 may be disposed within the suction-pressure chamber 30 and may include a main bearing housing 38 and a bearing 40. The main bearing housing 38 may house the bearing 40 therein. The bearing 40 may be a rolling element bearing or any other suitable type of bearing. As shown in FIGS. 4 and 5, the main bearing housing 38 may include a plurality of cylindrically-shaped pins 41 extending in an axial direction from an axial end surface 42 of the main bearing housing 38. The pins 41 may be spaced apart from each other and may be disposed circumferentially around the axial end surface 42 of the main bearing housing 38. Each pin 41 may have a proximate end 43 and a distal end 44. The proximate end 43 may extend from the axial end surface 42 of the main bearing housing 38. The distal end 44 may be coupled to driveshaft 46 such that the bearing housing 38 is coupled to the driveshaft 46. In some configurations, the pins 41 may be separate components that are attached to the axial end surface 42 of the main bearing housing 38 through threads or a press-fit instead of being integrally formed with the axial end surface 42 of the main bearing housing 38.

The motor assembly 16 may be disposed within the suction-pressure chamber 30 and may include a motor stator 52 and a rotor 54. The motor stator 52 may be attached to the shell 22 (e.g., via press fit, staking, and/or welding). The rotor 54 may be attached to driveshaft 46 (e.g., via press fit, staking, and/or welding). The driveshaft 46 may be driven by the rotor 54 and may be supported by bearing 59 for rotation relative to the shell assembly 12. The bearing 59 may be fixed to the first end cap 24 of the shell assembly 12. In some configurations, the motor assembly 16 is a variable-speed motor. In other configurations, the motor assembly 16 could be a multi-speed motor or a fixed-speed motor.

The driveshaft 46 may include a driveshaft section 56 and a hub section 58. The driveshaft section 56 may include a suction passage 62. The suction passage 62 provides fluid communication between the suction gas inlet fitting 32 and the compression mechanism 18. An inlet 65 of the suction passage 62 may be disposed at or near a first end 67 of the driveshaft section 56 adjacent the suction gas inlet fitting 32. An outlet 66 of the suction passage 62 may be disposed at or near a second end 69 of the driveshaft section 56 adjacent to the compression mechanism 18.

Figure 3:
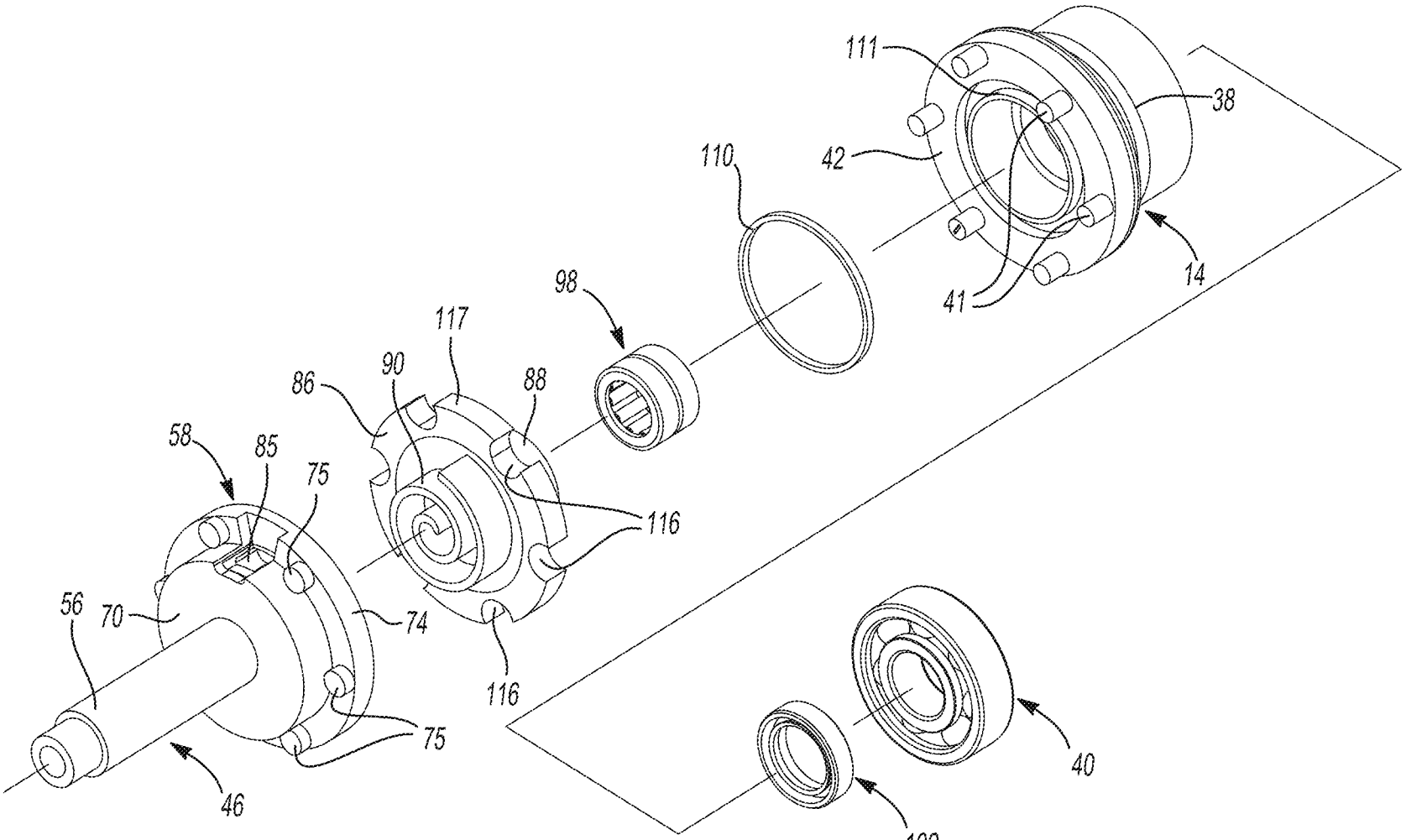
FIG. 3 is an exploded view of the compression mechanism and the bearing housing of the compressor of FIG. 1.

The hub section 58 may extend from the second end 69 of the driveshaft section 56 and may include a first portion 70, a second portion 72 and a flange 74. The first portion 70 extends in a radial direction from the second end 69 of the driveshaft section 56 (in a direction perpendicular to a rotational axis A1 of driveshaft 46) and the second portion 72 extends in an axial direction from a periphery of the first portion 70 (in a direction parallel to a rotational axis A1 of driveshaft 46). The flange 74 extends in a radial direction from an end of the second portion 72 and includes a plurality of pin housings 75. As shown in FIG. 3, the pin housings 75 are spaced apart from each other and are circumferentially disposed around the flange 74. Each pin 41 extending from the main bearing housing 38 is received in a respective pin housing 75, thereby coupling the main bearing housing 38 and the driveshaft 46 to each other. In this manner, rotation of the driveshaft 46 causes corresponding rotation of the main bearing housing 38 about the rotational axis A1 of the driveshaft 46.

The compression mechanism 18 may be disposed within the suction-pressure chamber 30. The compression mechanism 18 may include a first compression member and a second compression member that cooperate to define fluid pockets (i.e., compression pockets) therebetween. For example, the compression mechanism 18 may be a co-rotating scroll compression mechanism in which the first compression member is a first scroll member (i.e., a driver scroll member) 76 and the second compression member is a second scroll member (i.e., a driven scroll member) 78.

The first scroll member 76 may include a first end plate 80 and a first spiral wrap 82 extending from the first end plate 80. The first end plate 80 is disposed within and fixed to the hub section 58 of the driveshaft 46 such that the hub section 58 surrounds the first spiral wrap 82. In some configurations, the first scroll member 76 and the driveshaft 46 may be a single component as opposed two separate components fixed to each other. The first end plate 80 may include a radially extending passage 84*a* and an axially extending passage 84*b*. The radially extending passage 84*a* is formed in the first end plate 80 and extends from a central area of the first end plate 80 to the axially extending passage 84*b*. The axially extending passage 84*b* extends from an end of the radially extending passage 84*a* to a suction inlet 85 of the first scroll member 76. In this way, suction gas flowing through the suction passage 62 may flow through the passages 84*a*, 84*b* and into an outermost pocket of the fluid pockets via the suction inlet 85. A portion of the suction gas flowing through the passages 84*a*, 84*b* may exit into the suction pressure-chamber 30.

The second scroll member 78 defines a second rotational axis A2 that is parallel to the rotational axis A1 and offset from the rotational axis A1. The second scroll member 78 may include a second end plate 86, a cylindrical hub 88 extending from one side of the second end plate 86, and a second spiral wrap 90 extending from the opposite side of the second end plate 86. A bearing support member 92 (e.g., a generally cylindrical shaft or body with a discharge passage 93) is fixed relative to the partition 25 and includes a first end 94 extending at least partially into the discharge-pressure chamber 33 and a second end 96 extending through the bearing 40 and into the hub 88 (the bearing 40 and the hub 88 are disposed within the suction-pressure chamber 30). The discharge passage 93 extends axially through the bearing support member 92 (i.e., through the first and second ends 94, 96) and provides fluid communication between the compression mechanism 18 and the discharge-pressure chamber 33. The hub 88 of the second scroll member 78 is rotatably supported by a bearing 98 (e.g., a needle bearing) that is positioned between the hub 88 and the bearing support member 92.

A sealing assembly 102 is disposed within the main bearing housing 38 and includes a housing 104 and a sealing member 106. The housing 104 is press-fitted within the main bearing housing 38 such that an outer diametrical surface 107 of the housing 104 is sealingly engaged with an inner diametrical surface 108 of the main bearing housing 38. The sealing member 106 is disposed within the housing 104 and is sealingly engaged with an outer diametrical surface 109 of the bearing support member 92. In this way, fluid discharged from the fluid pockets of the compression mechanism 18 is prevented from flowing to the bearing 40 and to the suction chamber 30.

The first and second spiral wraps 82, 90 are intermeshed with each other and cooperate to form a plurality of fluid pockets (i.e., compression pockets) therebetween. Rotation of the first scroll member 76 about the rotational axis A1 and rotation of the second scroll member 78 about the second rotational axis A2 causes the fluid pockets to decrease in size as they move from a radially outer position to a radially inner position, thereby compressing the working fluid therein from the suction pressure to the discharge pressure.

The second end plate 86 may be disposed axially between the first end plate 80 and the main bearing housing 38. Annular seals 110 may be disposed within a groove 111 formed in the axial end surface 42 of the main bearing housing 38 and may sealingly and slidably engage the second end plate 86 to form an annular biasing chamber 112. The annular seals 110 keep the biasing chamber 112 sealed off from the suction-pressure chamber 30 and the discharge gas while still allowing relative movement between the main bearing housing 38 and the second scroll member 78. The second end plate 86 may include a biasing passage (not shown) that provides fluid communication between an intermediate-pressure compression pocket and the biasing chamber 112.

The second end plate 86 may include a discharge passage 114 and a plurality of arcuate shaped pin pockets or scallops 116 (FIGS. 3-5). The discharge passage 114 extends through the second end plate 86 and provides fluid communication between a radially innermost one of the fluid pockets and the discharge-gas-outlet fitting 34 (via the passage 93 in the bearing support member 92). A discharge valve (e.g., a reed valve or other check valve) may be disposed within or adjacent the discharge passage 114 or at the end 94 of the bearing support member 92. The discharge valve allows working fluid to be discharged from the compression mechanism 18 through the discharge passage 114 and into the bearing support member 92 and prevents working fluid in the bearing support member 92 from flowing back into to the compression mechanism 18. A portion of the discharge gas flowing out of the discharge passage 114 may flow through the passage 93 of the bearing support member 92, into the discharge-pressure chamber 33 and out of the compressor 10 through the discharge-gas-outlet fitting 34. Another portion of discharge gas flowing out of the discharge passage 114 may flow around the second end 96 of the bearing support member 92 and through the bearing 98 and may flow into a pocket 115 formed radially between the hub 88 and the bearing housing 38. In this way, discharge gas within the pocket 115 and intermediate working fluid in the biasing chamber 112 axially biases the second scroll member 78 toward the first scroll member 76.

The pin pockets 116 and the pins 41 form the synchronization mechanism. As shown in FIGS. 3-5, the pin pockets 116 may be spaced apart from each other and may be formed in an outer diametrical surface 117 of the second end plate 86. The pin pockets 116 may also be disposed around the second end plate 86 and may receive a respective pin 41 of the main bearing housing 38 (each pin 41 extends through a respective pin pocket 116 formed in the second end plate 86). As shown in FIG. 5, each pin pocket 116 defines a working surface 118, a non-working surface 120 and a transition surface 122.

The working surface 118 has a first arc center X. The working surface 118 spans an angle A. In some configurations, the angle A may be at least 60 degrees. The working surface 118 may span an angle A that is defined by 360/Npin, where Npin is the number of pins. Each pin 41 is configured to engage a corresponding working surface 118 during a portion of the revolution of the first scroll member 76, which causes energy from the driveshaft 46 to be transferred to the second scroll member 78 thereby rotating the second scroll member 78 about the second rotational axis A2. For example, in the embodiment shown in the figures, one pin 41*a* of the six pins 41 is configured to engage a corresponding working surface 118 (the other pins 41 are disengaged from corresponding working surfaces 118) at any given time. In this way, compressor 10 provides for radial compliance (i.e., displacement of the rotational axis A1 relative to the rotational axis A2).

The non-working surface 120 has a second arc center Y that is spaced apart from the first arc center X. Each pin 41 is spaced apart from a corresponding non-working surface 120 during its path of movement within the pin pocket 116 (the pin 41 does not engage the non-working surface 120 as the driveshaft 46 and the bearing housing 38 rotate about the first rotational axis A1). The transition surface 122 is disposed between the working surface 118 and the non-working surface 120. Each pin 41 is configured to be moveably engaged to a corresponding transition surface 122 after engaging the corresponding working surface 118 and prior to disengaging from the second end plate 86. When one pin 41 engages the corresponding transition surface 122, an adjacent pin 41 engages the corresponding working surface 118. For example, as shown in FIG. 4, pin 41*b* is engaged with the corresponding transition surface 122 as the adjacent pin 41*a* engages the corresponding working surface 118. During further rotation of the driveshaft 46, the pin 41*b* will disengage from the corresponding transition surface 122 as pin 41*a* traverses the corresponding working surface 118.

One of the benefits of the compressor 10 of the present disclosure is the pins 41 being configured to engage the second end plate 86 to rotate the second scroll member 78 while still providing for radial compliance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell assembly;

a first compression member rotatable relative to the shell assembly about a first axis;

a bearing housing coupled to the first compression member and rotatable relative to the shell assembly about the first axis, the bearing housing including a first pin extending therefrom; and a second compression member rotatable relative to the shell assembly about a second axis that is spaced apart from the first axis, the second compression member cooperates with the first compression member to define fluid pockets, the second compression member including a base plate and a first pin pocket, the first pin pocket formed in the base plate and receiving the first pin, wherein the first compression member is moveable between a first position in which the first pin is engaged with a surface of the first pin pocket and a second position in which the first pin is disengaged from the surface of the first pin pocket.

2. The compressor of claim 1, wherein the first pin pocket is arcuate and the surface of the first pin pocket is a working surface having a first arc center, and wherein the first pin pocket further includes a non-working surface having a second arc center that is spaced apart from the first arc center.

3. The compressor of claim 2, wherein the working surface spans a predetermined angle, and wherein the predetermined angle is defined by 360 degrees/number of pins.

4. The compressor of claim 2, wherein the first pin is disengaged from the working surface and the non-working surface when the first compression member is in the second position.

5. The compressor of claim 2, wherein the first pin pocket further includes a transition surface disposed between the working surface and the non-working surface, and wherein the first compression member is movable to a third position in which the first pin is moveably engaged with the transition surface.

6. The compressor of claim 2, wherein the bearing housing includes a second pin and the second compression member includes an arcuate-shaped second pin pocket formed in the base plate, the second pin extends through the second pin pocket, and wherein the second pin pocket includes a second working surface having a third arc center, a second non-working surface and a transition surface disposed between the second working surface and the second non-working surface, the second pin is engaged with the transition surface when the first compression member is in the first position.

7. The compressor of claim 6, wherein the second pin is adjacent to the first pin.

8. The compressor of claim 6, further comprising a driveshaft coupled to the first compression member and including first and second housings that receive respective first and second pins thereby coupling the first compression member and the bearing housing.

9. The compressor of claim 1, wherein the first pin pocket is formed in an outer diametrical surface of the base plate.

10. The compressor of claim 1, further comprising a driveshaft coupled to the first compression member and including a first housing that receives the first pin thereby coupling the first compression member and the bearing housing.

11. A compressor comprising:

a shell assembly;

a first compression member rotatable relative to the shell assembly about a first axis;

a bearing housing coupled to the first compression member and rotatable relative to the shell assembly about the first axis, the bearing housing including a plurality of pins extending therefrom; and a second compression member rotatable relative to the shell assembly about a second axis that is spaced apart from the first axis, the second compression member cooperates with the first compression member to define fluid pockets, the second compression member including:

a base plate; and pin pockets formed in the base plate and receiving a respective pin, each of the pin pockets having a working surface, wherein the first compression member is moveable between a first position in which only one of the pins of the plurality of pins is engaged with the working surface of a respective pin pocket and a second position in which the one of the pins of the plurality of pins is disengaged from the working surface of the respective pin pocket.

12. The compressor of claim 11, wherein the working surface of each pin pocket has a first arc center and a non-working surface of each pin pocket has a second arc center, and wherein the second arc center is spaced apart from the first arc center.

13. The compressor of claim 12, wherein each of the pin pockets has a transition surface disposed between the working surface and the non-working surface, and wherein only one of the pins of the plurality of pins is engaged with the transition surface of a respective pin pocket when the first compression member is in the first position.

14. The compressor of claim 11, wherein the pin pockets are circumferentially disposed and spaced apart around the base plate and the pins are circumferentially disposed and spaced apart around an axial end surface of the bearing housing, and wherein the pin pockets are arcuate-shaped and formed in an outer diametrical surface of the base plate and extend through the base plate.

15. A compressor comprising:

a shell assembly;

a first compression member rotatable relative to the shell assembly about a first axis;

a second compression member rotatable relative to the shell assembly about a second axis that is spaced apart from the first axis, the second compression member cooperates with the first compression member to define fluid pockets, the second compression member including a base plate and an arcuate-shaped pin pocket, the pin pocket formed in the base plate; and a pin coupled to the first compression member and received in the pin pocket, wherein the first compression member is moveable between a first position in which the pin is engaged with a surface of the pin pocket and a second position in which the pin is disengaged from the surface of the pin pocket, wherein the surface of the pin pocket is a working surface having a first arc center, and wherein the pin pocket further includes a non-working surface having a second arc center that is placed apart from the first arc center.

16. The compressor of claim 15, wherein the working surface has a predetermined angle, and wherein the predetermined angle is defined by 360 degrees/number of pins.

17. The compressor of claim 15, wherein the pin is disengaged from the working surface and the non-working surface when the first compression member is in the second position.

18. The compressor of claim 15, wherein the pin pocket further includes a transition surface disposed between the working surface and the non-working surface, and wherein the first compression member is movable to a third position in which the pin is moveably engaged with the transition surface.

19. The compressor of claim 15, further comprising a bearing housing coupled to the first compression member and rotatable relative to the shell assembly about the first axis.

* * * * *